US010161121B1

(12) United States Patent
Kalmanson

(10) Patent No.: US 10,161,121 B1
(45) Date of Patent: Dec. 25, 2018

(54) ADJUSTABLE ASSEMBLY FOR INCREASING MECHANICAL ADVANTAGE IN ACTUATING A DRAIN STOPPER

(71) Applicant: Barry Kalmanson, Maitland, FL (US)

(72) Inventor: Barry Kalmanson, Maitland, FL (US)

( * ) Notice: Subject to any disclaimer, the term of this patent is extended or adjusted under 35 U.S.C. 154(b) by 0 days.

(21) Appl. No.: 15/858,606

(22) Filed: Dec. 29, 2017

(51) Int. Cl.
*E03C 1/23* (2006.01)

(52) U.S. Cl.
CPC ..... *E03C 1/2302* (2013.01); *E03C 1/2306* (2013.01)

(58) Field of Classification Search
CPC ..... E03C 1/2302
USPC ..... 4/688–692, 286–295
See application file for complete search history.

(56) References Cited

U.S. PATENT DOCUMENTS

2003/0179564 A1* 9/2003 Ganci ..... G02B 6/0036 362/23.16
2013/0312177 A1* 11/2013 Tong ..... E03C 1/2302 4/689

* cited by examiner

*Primary Examiner* — Christine Skubinna
(74) *Attorney, Agent, or Firm* — Antonio G. Tapia

(57) ABSTRACT

An adjustable pop-up drain stopper assembly is provided comprising a push rod gear and pivot rod gear, both of which are housed in an enclosure. The push rod and pivot rod gears rotate about respective axles in the enclosure. The push rod gear and the pivot rod gear both have a lever arm extending through respective windows in the enclosure and are connected to a push rod and a pivot rod, respectively, of a sink. Teeth at arcuate ends of the push rod and pivot rod gears engage each other such that, when the push rod gear is rotated about its axle, the pivot rod gear rotates a corresponding amount about its axle. In use, when the push rod is raised or lowered, the motion is transferred by way of the gears to the pivot rod which, in turn, lowers or raises a pop-up stopper at the sink drain opening.

16 Claims, 10 Drawing Sheets

ADJUSTABLE ASSEMBLY FOR INCREASING MECHANICAL ADVANTAGE IN ACTUATING A DRAIN STOPPER

TECHNICAL FIELD

This invention relates generally to sink drains. More specifically, this invention relates to an easily adjustable and easily usable pop-up drain stopper assembly.

BACKGROUND OF THE INVENTION

Conventional pop-up drain stopper assemblies include a push rod adjacent the faucet which when vertically translated actuates the stopper up or down. Connected to the push rod is a pivot rod, which protrudes into the drain conduit and engages a bottom portion of the drain stopper. Pushing the push rod down raises the drain stopper, thereby unsealing the drain stopper from the sink or basin and allowing water to drain. Pulling the push rod up causes the pivot rod to retract and pull the drain stopper with it so as to seal the sink or basin and retain water. A number of disadvantages attend such means. The traditional pop-up drain stopper assembly is cumbersome to adjust given varying sink dimensions. Further, the traditional pop-up drain stopper may require periodic adjustment in order for it to maintain a seal around the drain opening as the clip connecting the push rod to the pivot rod may slip over time.

Information relevant to attempts to address at least the first of these problems can be found in U.S. Pat. No. 4,594,738 (Gebert) wherein Gebert attempts to solve the problem of bathtub drains and overflows being at different heights on bathtubs of different dimensions. Gebert provides a drain and overflow device with a turn knob that, through a shaft, a lever, a cable, a pusher, two more levers, and another shaft, along with assorted connectors, causes the drain valve to open and close. However, Gebert suffers from at least one or more of the following disadvantages: the device is designed for bathtubs and would not easily adapt to sink drains; the device is mechanically complicated; and mechanical energy is lost in actuating the drain stopper.

Thus, in the applicant's experience there is a need for a pop-up drain stopper mechanism that is easily adjustable to sinks of various dimensions and that has an increased mechanical advantage to provide a consistently secure sealing of the drain opening. The device of the present invention is believed to accomplish all of the foregoing objectives.

SUMMARY OF THE INVENTION

The present invention provides a new and useful pop-up drain stopper assembly that is adjustable and easy to actuate. This device is believed to be useful for both new and retrofit installations and is easily fitted to sinks of varying dimensions.

In one of its basic embodiments, the pop-up sink drain stopper assembly of the present invention comprises a push rod gear and pivot rod gear, both of which are generally spatula shaped and have a plurality of gear teeth at their arcuate ends. The push rod gear and pivot rod gear each sport a central axle receiving bore. The push rod gear and pivot gear each have a lever arm whereon is an elongate awning ring shaft receiving bore. The push rod gear and pivot gear are encased in an apparatus consisting of a main horizontal body that is substantially hourglass shaped. The push rod gear end of the gear encasing apparatus has on its interior surface a push rod gear central axle and the pivot rod gear end has on its exterior surface a pivot rod gear central axle. The push rod gear central axle engages the central axle receiving bore of the push rod gear and the pivot rod gear central axle engages the central axle receiving bore of the pivot rod gear, allowing the push rod gear and the pivot rod gear to rotate about their respective axles. The gear teeth at the arcuate end of the push rod gear engage the teeth at the arcuate end of the pivot rod gear such that, when the push rod gear is rotated about its axle, the pivot rod gear rotates a corresponding amount about its axle. The push rod gear end of the gear encasing apparatus has a push rod gear lever arm window through which the lever arm of the push rod gear extends. Similarly, the pivot rod gear end of the gear encasing apparatus has a pivot rod gear lever arm window through which the lever arm of the pivot rod gear extends. A lid closes the gear encasing apparatus and secures the push rod gear and pivot gear within.

The gear encasing apparatus is secured to the drain pipe of a sink with an adjustable extension arm. A push rod is movably secured to the ring shaft receiving bore in the lever arm of the push rod gear and the drain pivot rod of the sink drain is movably secured to the ring shaft receiving bore in the lever arm of the pivot rod gear.

When the device is in use and the push rod is raised or lowered, the motion is transferred by way of the push rod gear and the pivot rod gear to the drain pivot which, in turn, lowers or raises the pop-up stopper at the drain opening in the sink.

Thus the present invention provides a new and useful pop-up drain stopper assembly that is adjustable to fit sinks of varying dimensions and is easy to actuate. This device is mechanically simple and provides a mechanical advantage that consistently secures the pop-up drain stopper in the drain opening.

The device of the present invention is believed to accomplish all of the foregoing objectives. Further features and objectives of the present invention will become apparent form the following detailed description and the accompanying drawings.

DETAILED DESCRIPTION OF THE INVENTION

As described above, the present invention provides a new and useful pop-up drain stopper assembly that is easy to actuate, is adjustable to sinks of various dimensions, and has an increased mechanical advantage to provide a consistently secure sealing of the drain opening. This device is believed to be useful for both new and retrofit installations. The following description and accompanying drawings disclose at least one version of the device.

Figure 1:
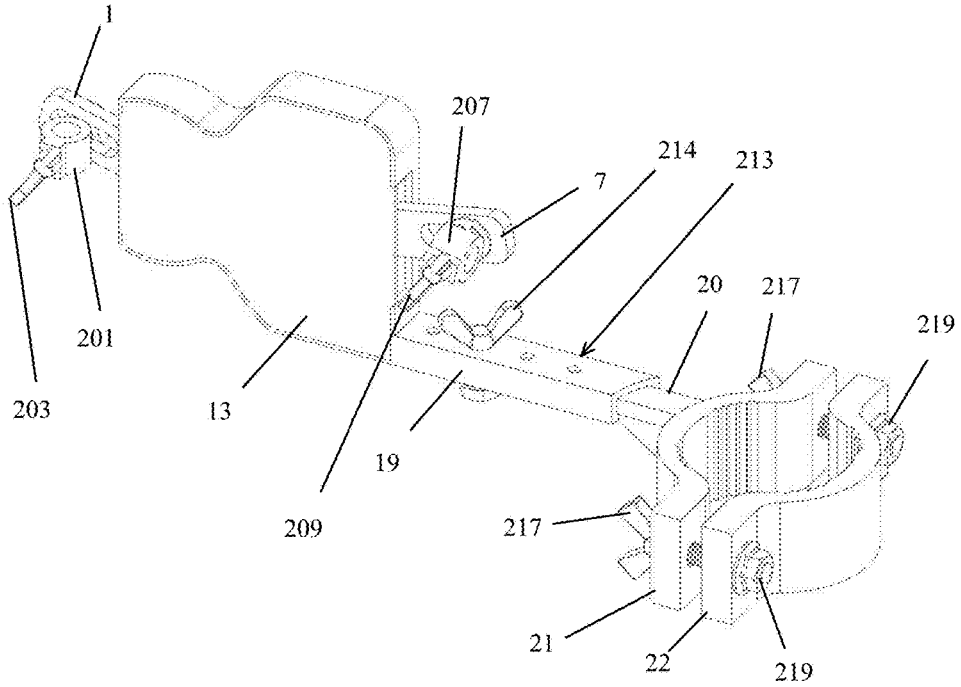
FIG. 1 is an isometric perspective view of an assembled adjustable drain stopper assembly according to the present invention.
Figure 2:
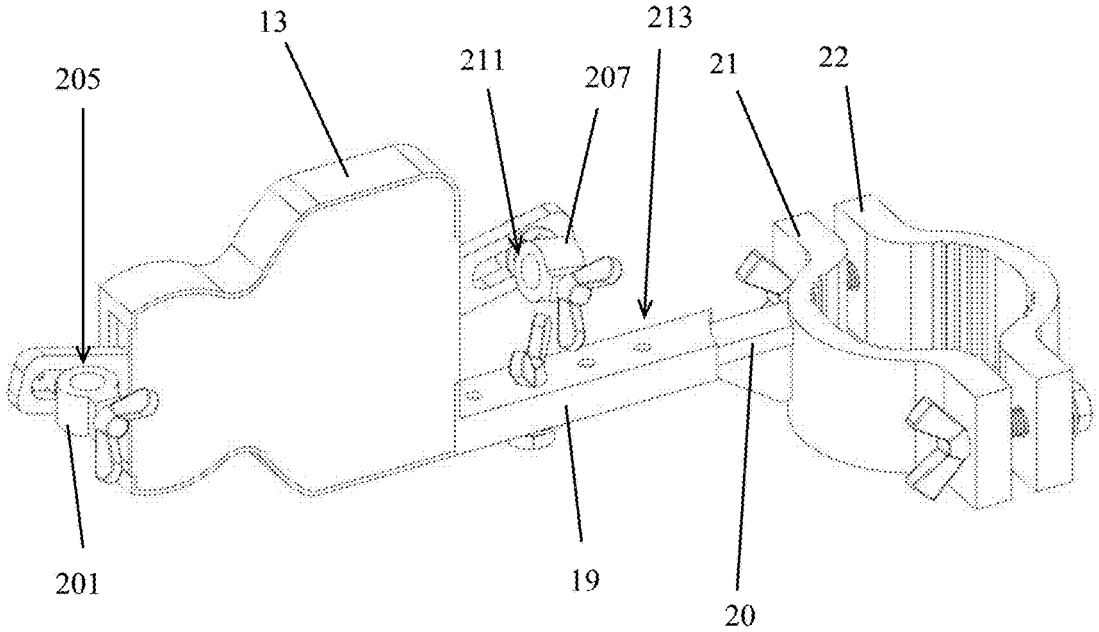
FIG. 2 is another isometric perspective view of the assembled adjustable drain stopper assembly according to the present invention.
Figure 3:
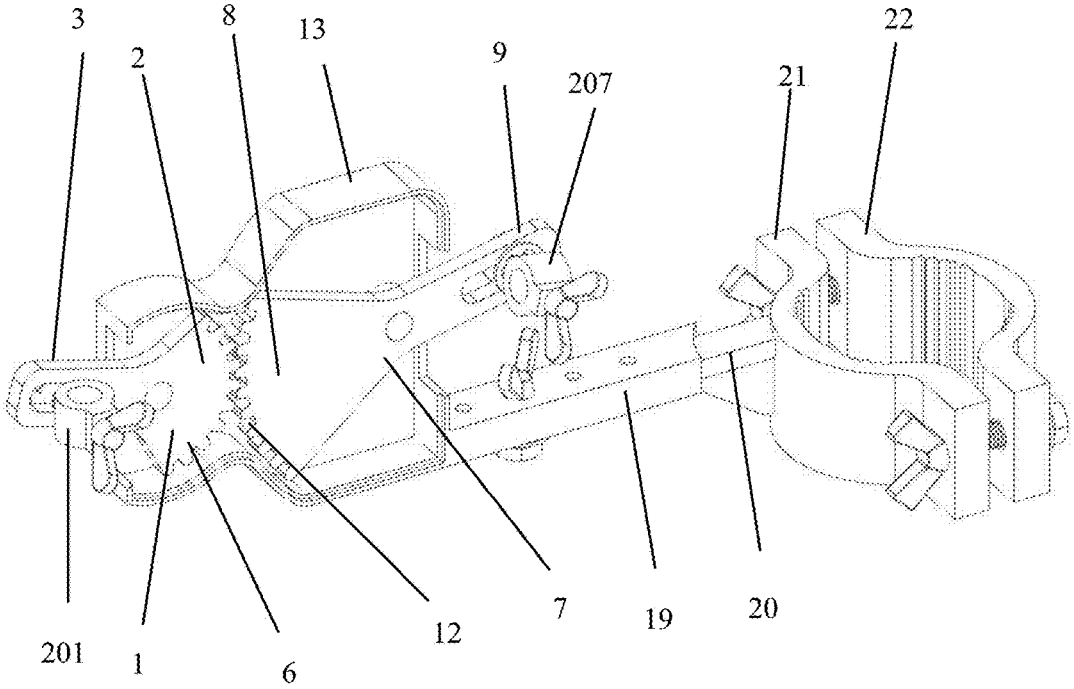
FIG. 3 is an isometric perspective view of the partially assembled adjustable drain stopper assembly according to the present invention.
Figure 4:
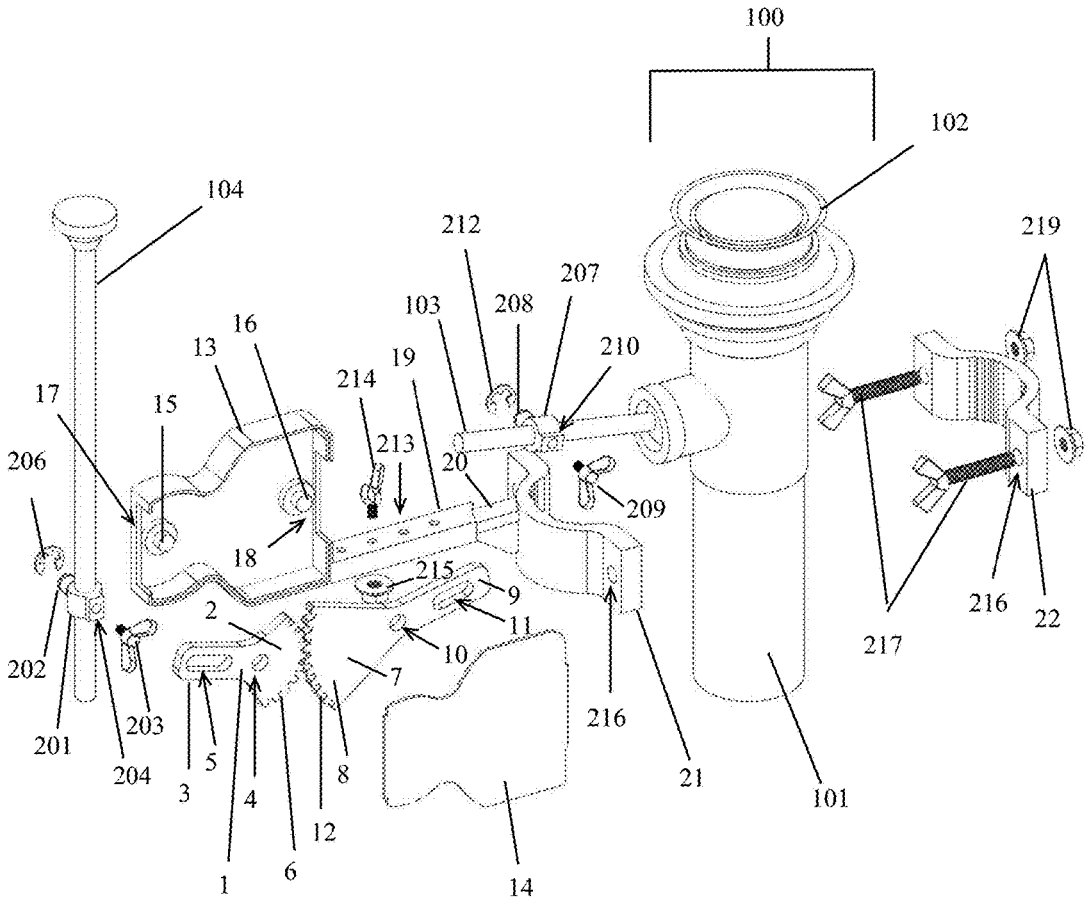
FIG. 4 is an exploded view of the adjustable drain stopper assembly according to the present invention.
Figure 5:
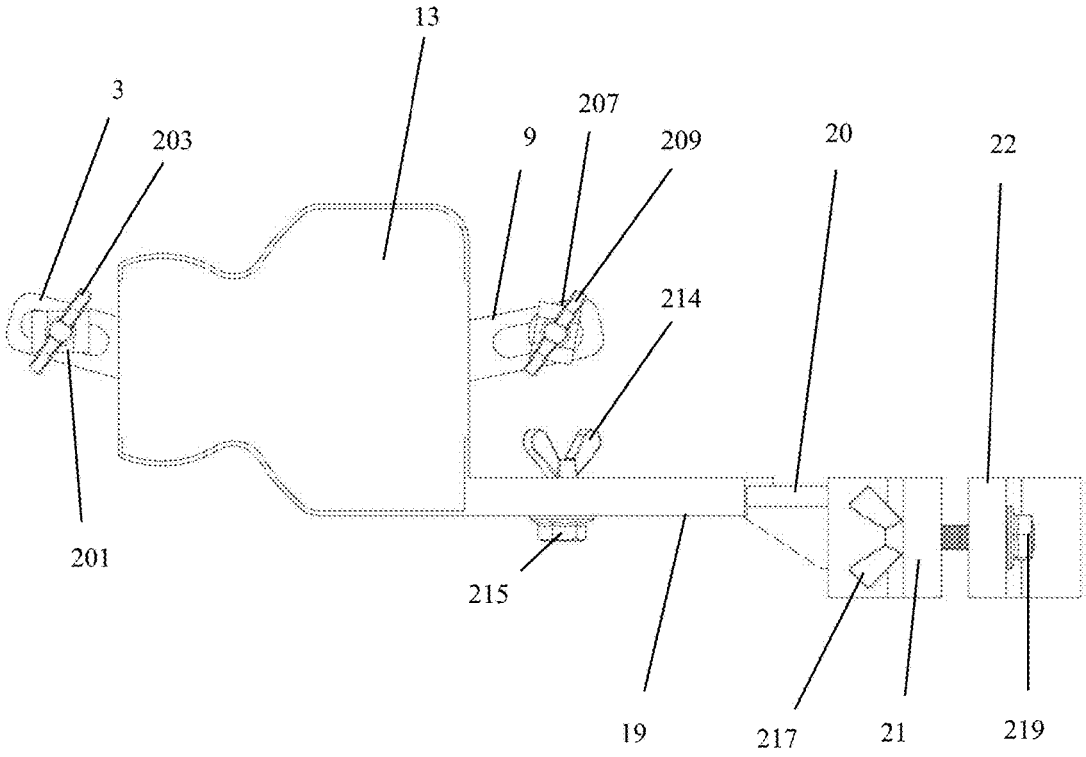
FIG. 5 is front elevation view of the adjustable drain stopper assembly according to the present invention.
Figure 6:
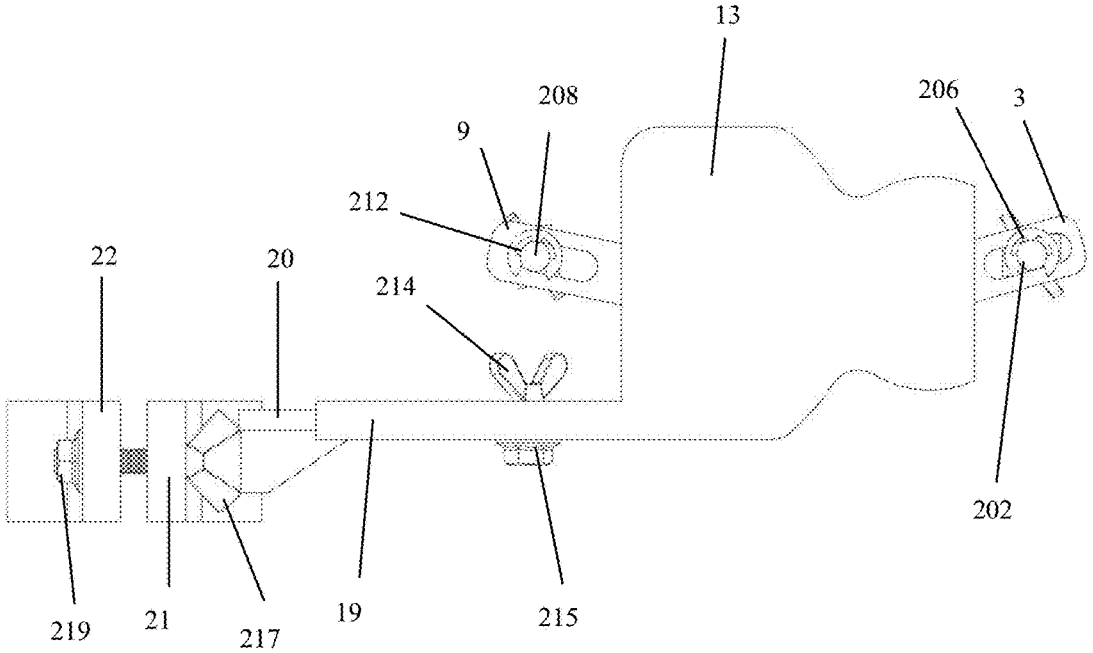
FIG. 6 is back side elevation view of the adjustable drain stopper assembly according to the present invention.
Figure 7:
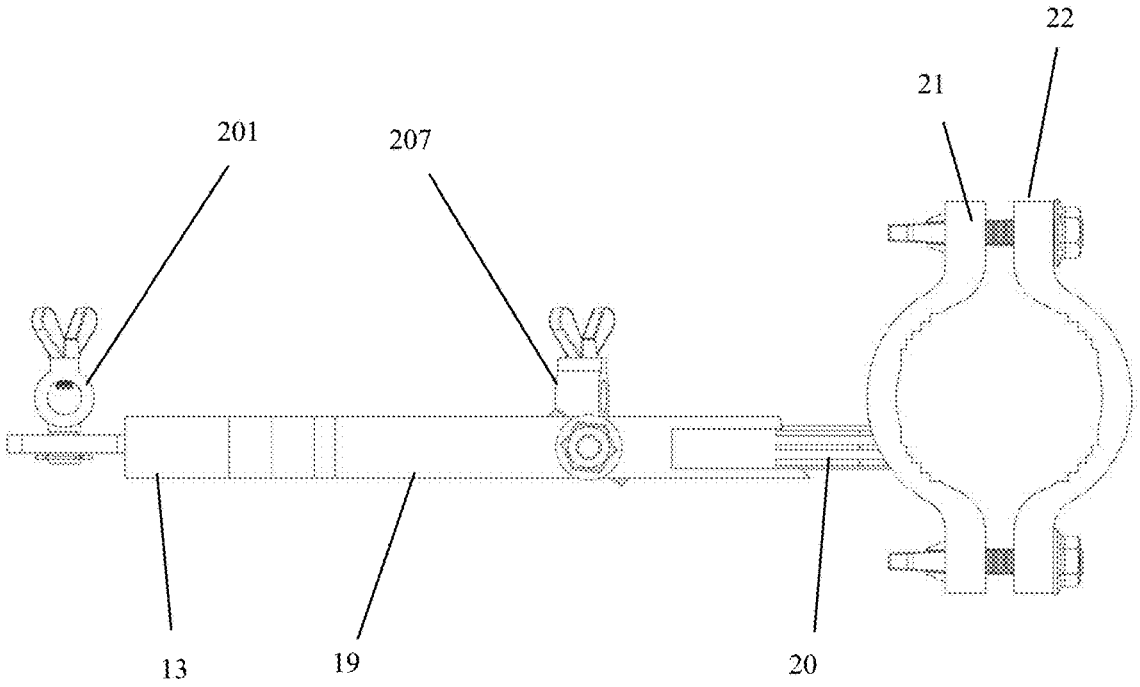
FIG. 7 is bottom elevation view of the adjustable drain stopper assembly according to the present invention.
Figure 8:
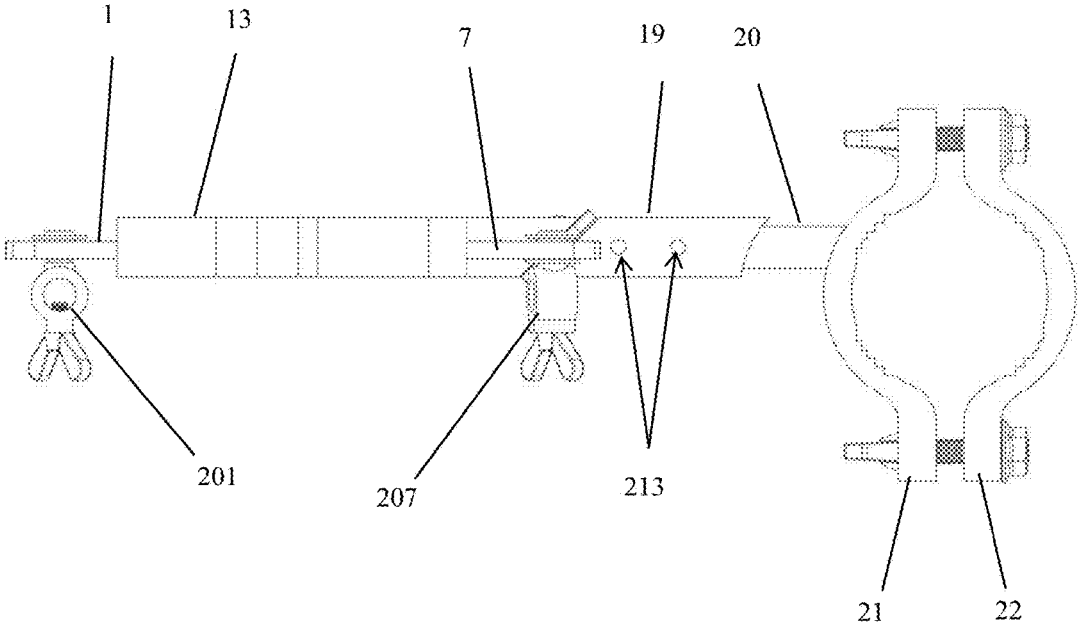
FIG. 8 is top elevation view of the adjustable drain stopper assembly according to the present invention.
Figure 9:
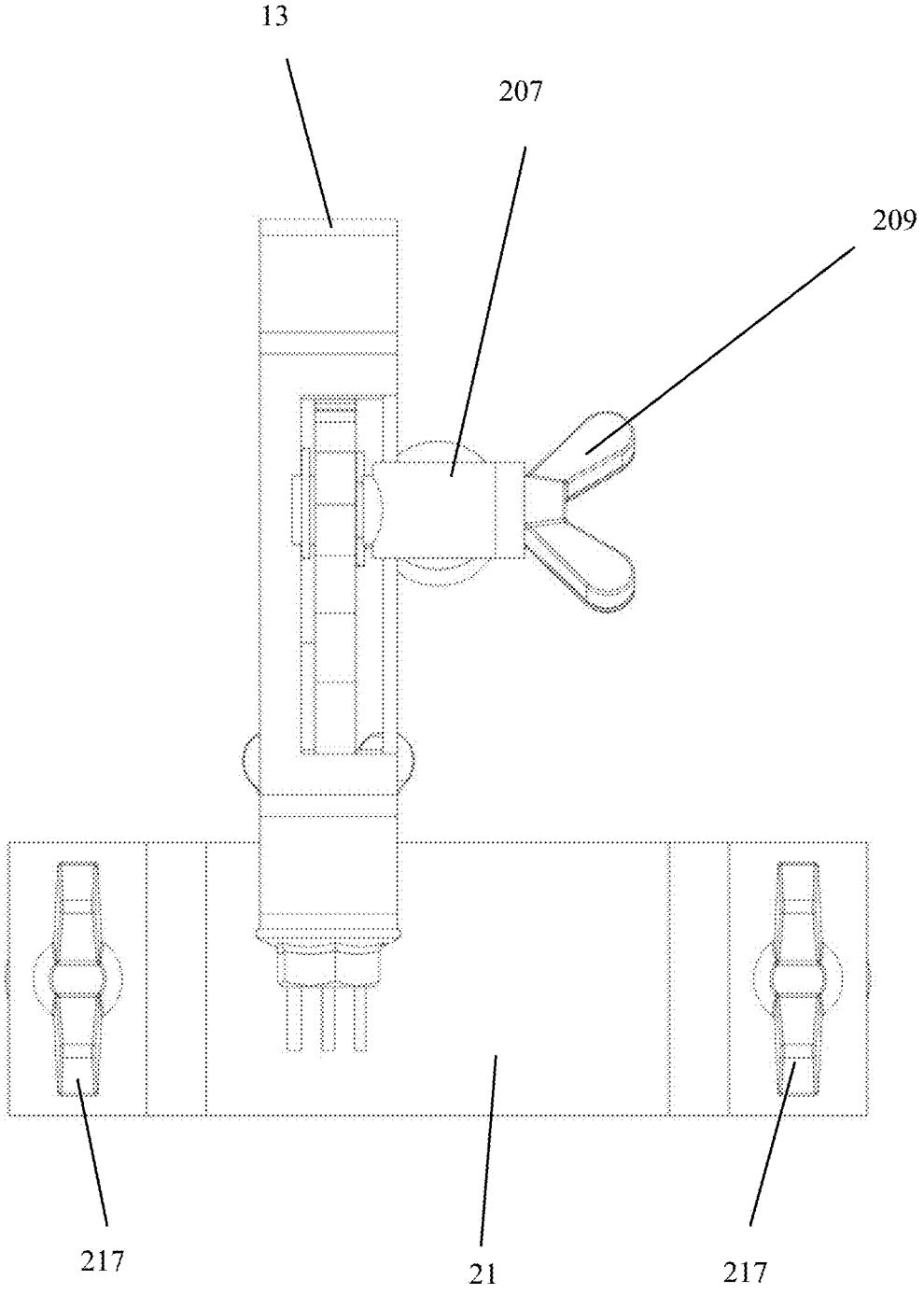
FIG. 9 is left side elevation view of the adjustable drain stopper assembly according to the present invention.
Figure 10:
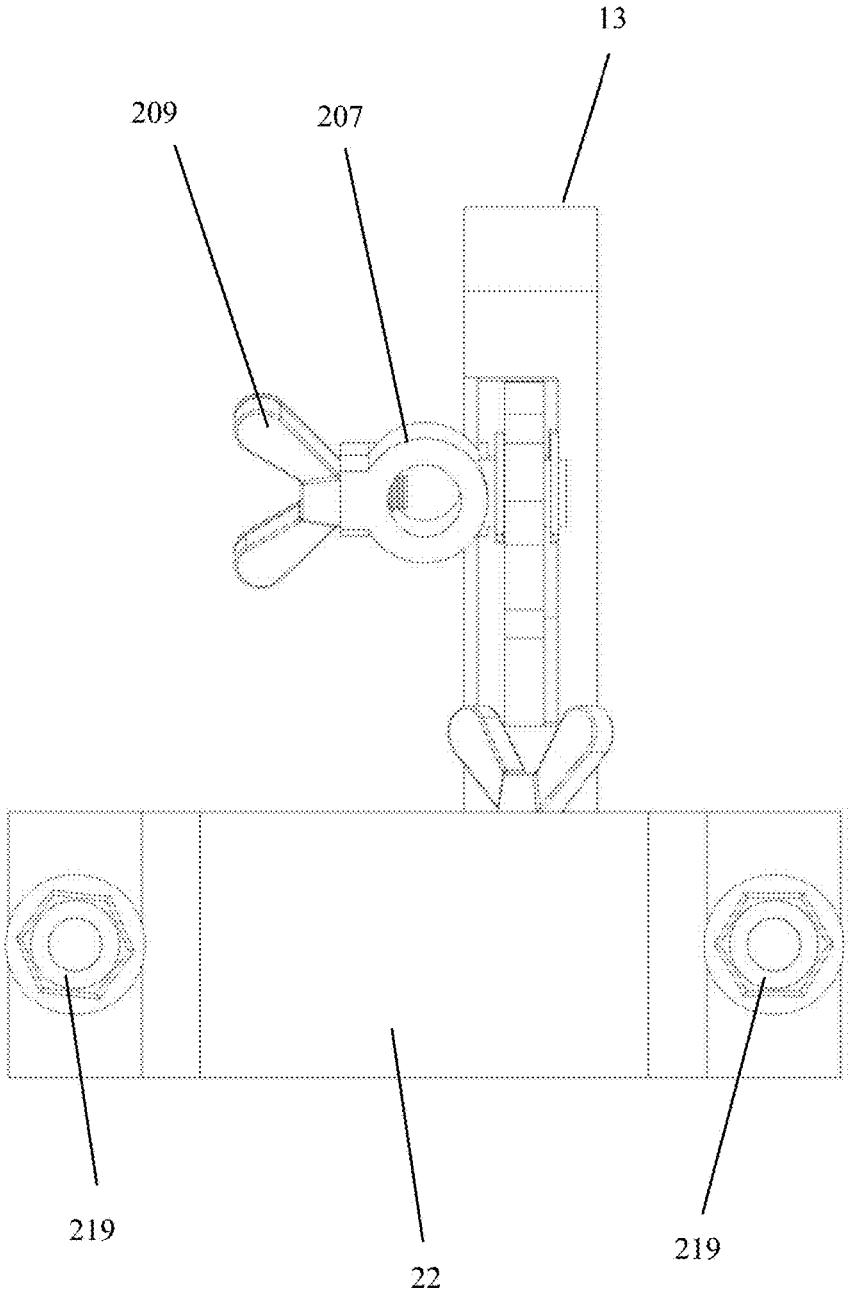
FIG. 10 is right side elevation view of the adjustable drain stopper assembly according to the present invention.

Referring now to the invention in more detail in FIG. 1 to FIG. 10 there is shown a pop-up drain stopper assembly which comprises an enclosure 13 housing a push rod gear 1 and a pivot rod gear 7, a clamp assembly 21, 22, respectively, and an adjustable extension arm 19, 20 to connect the enclosure 13 to the clamp assembly 21, 22. In more detail, still referring to the invention of FIG. 1 to FIG. 10 and particularly to FIG. 3 and FIG. 4, the push rod gear 1 is generally spatula shaped and has a plurality of gear teeth 6 at the arcuate end 2 and a lever arm 3 at the end opposite the arcuate end 2. An axle receiving bore 4 is formed through the center of the push rod gear 1 and an elongate awning ring shaft receiving bore 5 is formed through the lever arm 3. Similarly, the pivot rod gear 7 is generally spatula shaped and has a plurality of gear teeth 12 at the arcuate end 8 and a lever arm 9 at the end opposite the arcuate end 8. An axle receiving bore 10 is formed through the center of the pivot rod gear 7 and an elongate awning ring shaft receiving bore 11 is formed through the lever arm 9. The push rod gear 1 is smaller than the pivot rod gear 7.

The gear enclosure 13 is substantially hourglass shaped and has side walls extending outward from a rear plate. A push rod gear lever arm window 17 is formed in the sidewall at the smaller end of the gear enclosure 13 and a pivot rod gear lever arm window 18 is formed in the sidewall at the larger end of the gear enclosure 13. A push rod gear central axle 15 extends from the inside of the rear plate at one end of the gear enclosure 13 and a pivot rod gear central axle 16 extends from the inside of the rear plate at the opposite end of the gear enclosure 13. The push rod gear 1 is placed into the gear enclosure 13 with the push rod gear lever arm 3 extending through the push rod gear lever arm window 17 by fitting the axle receiving bore 4 onto the push rod gear central axle 15. Similarly, the pivot rod gear 7 is placed into the gear enclosure 13 with the pivot rod gear lever arm 9 extending through the pivot rod gear lever arm window 18 by fitting the axle receiving bore 10 onto the pivot rod gear central axle 16. When assembled, the push rod gear teeth 6 engage with the pivot rod gear teeth 12 allowing the push rod gear 1 and pivot rod gear 7 to rotate together about their respective axles 15, 16. A front lid 14 closes the gear enclosure 13, securing the push rod gear 1 and pivot rod gear 7 within the gear enclosure 13.

The clamp assembly includes an anterior drain pipe clamp 21 and a posterior drain pipe clamp 22. One end of a first section 19 of the extension arm is secured to the larger end of the gear enclosure 13 and one end of a second section 20 of the extension arm is secured to the anterior drain pipe clamp 21. In the embodiment illustrated, the second section 20 is slidable inside the first section 19. In another embodiment, the first section 19 is slidable within the second section 20. A series of spaced-apart openings 213 are formed through the first and second sections 19, 20 of the extension arm.

In order to secure the pop-up drain stopper assembly to a drain pipe assembly 100 (FIG. 4), the anterior drain pipe clamp 21 and a posterior drain pipe clamp 22 are connected to each other around a drain pipe 101 with thumb screws 217 through bores 216, 218 in the anterior and posterior clamps 21, 22 and secured with flange nuts 29. In an alternative embodiment, the bores 216, 218 may be threaded and conventional or thumb screws or bolts may be screwed into the bore 216, 218 to tighten the clamps 21, 22 against each other. The first section 19 of the extension arm, with the attached gear enclosure 13, is extended along the second section 20 towards or away from the drain pipe 101 until the push rod lever arm 3 is adjacent the push rod 104 of the drain pipe assembly 100. A thumb screw 214 is inserted from one side through the appropriate bores in the first and second sections 19, 20 of the extension arm to engage and tighten against a flange nut 215 on the opposite side. It will be appreciated that other means may be used to adjustably secure the enclosure 13 to the drain pipe 101. For example, the first section 19 may have threaded bores into which conventional or thumb screws or bolts may be screwed and tightened against the surface of the second section 20 of the extension arm.

With the gear enclosure 13 at the desired distance from the drain pipe 101, the drain push rod 104 is secured to the lever arm of the push rod gear 1 by sliding the bore 205 of a pivot rod awning ring 201 onto the end of the push rod 104 and securing it by tightening a thumb screw 203 against the push rod 104 through a screw bore 204 in one side of the awning ring 201. Extending from the other side of the awning ring 201 is an awning ring shaft 202, which is inserted through the elongated awning ring shaft receiving bore 5 in the lever arm 3 of the push gear 1. An e-ring 206 is placed onto the ring shaft 202 to hold the drain push rod 104 to the push gear 1 while allowing the two to move relative to each other.

Similarly, the drain pivot rod 103 is secured to the lever arm of the pivot rod gear 7 by sliding the bore 211 of a pivot rod awning ring 207 onto the end of the pivot rod 103 and securing it by tightening a thumb screw 209 against the pivot rod 103 through a screw bore 210 in one side of the awning ring 207. Extending from the other side of the awning ring 207 is an awning ring shaft 208, which is inserted through the elongated pivot rod awning ring shaft receiving bore 11 in the lever arm 9 of the pivot gear 7. An e-ring 212 is placed onto the ring shaft 208 to hold the pivot rod 103 to the pivot gear 7 while allowing the two to move relative to each other.

To use, the push rod 104 is raised and lowered in the conventional fashion to lower and raise the pop-up stopper 102 at the top of the drain pipe 101. When the push rod 104 is raised, the outer end of the lever arm 3 of the push rod gear 1 is also raised with the ring shaft 202 sliding along the receiving bore 5 to maintain the push rod 104 in a vertical orientation. Upward movement of the lever arm 3 causes the teeth 6 at the arcuate end 2 to rotate downward around the central axle 15. In response, the teeth 12 at the arcuate end 8 of the pivot rod gear 7 rotate upward around the central axle 16, in turn raising the lever arm 9. The connected end of the pivot rod 103 thus moves upward with the ring shaft 208 sliding along the receiving bore 11. Upward movement of the pivot rod 103 causes the pop-up stopper 102 to move downward, closing the opening in the top of the drain pipe 101.

The pop-up drain stopper assembly according to embodiments of the present invention is easily adjustable to accommodate sink and drain of varying configurations and dimensions. The assembly may be installed when a new sink is installed or may be retrofitted to an existing sink. Due to the pivot rod gear 7 being larger than the push rod gear 1, a mechanical advantage is provided whereby the force of the push rod movement is multiplied. Further, friction of the gear teeth 6, 12 against each other reduces the tendency of the pivot rod 103 or the push rod 104 to slip and cause the pop-up stopper 102 to lift from the drain opening. And, the awning rings 201, 207 are held firmly against their respective rods 104, 103 with the thumb screws 203, 209, making slippage less likely than when conventional clips are used to connect the push rod directly to the pivot rod.

The components of the apparatus according to the present invention can be made of any material of suitable strength and water resistance, such as stainless steel or some plastics. The gears 1, 7 and the awning rings 201, 207 are preferably made from a material that can withstand repeated motion against each other to prevent undue wear. Although no dimensions are claimed, it is envisioned that this device be of a size that corresponds with a wide range of sink configurations. The device may also be provided in several sizes to accommodate a broader range of sink configurations, from residential to commercial.

The previously described versions of the present invention have many advantages including and without limitation, the properties of being that it is easily adjustable to sinks of various dimensions, has an increased mechanical advantage to provide a consistently secure sealing of the drain opening, and is easy to actuate. It is also foreseen that the present invention shall also be used within any system which includes a drain assembly, for example a barrel, water tower, tubs and tankers. The device of the present invention is believed to accomplish all of the foregoing objectives. The invention does not require that all the advantageous features and all the advantages need to be incorporated into every embodiment of the invention.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. A pop-up drain stopper assembly, comprising:

a) a gear enclosure having a substantially hourglass shape, the gear enclosure having a first axle at a smaller end and a second axle at a larger end opposite the smaller end, the gear enclosure further having a first window formed in the smaller end and a second window formed in the larger end;

b) a push rod gear having an arcuate end and a first lever arm opposite the arcuate end, the arcuate end having a plurality of first gear teeth, the push rod gear further having a first elongated ring shaft receiving bore formed in the lever arm and a first axle receiving bore formed through a center thereof, the first axle receiving bore configured to receive the first axle, whereby the first lever arm extends through the first window and the push rod gear is rotatable about the first axle;

c) a pivot rod gear having an arcuate end and a second lever arm opposite the arcuate end, the arcuate end having a plurality of second gear teeth, the pivot rod gear further having a second elongated ring shaft receiving bore formed in the lever arm and a second axle receiving bore formed through a center thereof, the second axle receiving bore configured to receive the second axle, whereby the second lever arm extends through the second window, the pivot rod gear is rotatable about the second axle, and the first gear teeth engage with the second gear teeth;

d) an adjustable extension arm connected at a first end to the larger end of the gear enclosure;

e) a clamp assembly, comprising a posterior clamp and an anterior clamp to which a second end of the extension arm is connected, wherein said posterior and anterior clamps configured to be secured to each other around a drain pipe of a sink, whereby the gear enclosure is securable a selected distance from the drain pipe;

f) a first awning ring securable to a push rod of the sink, the first awning ring having a first ring shaft configured to extend through the elongated bore of the push rod gear;

g) a first ring shaft e-ring securable around the first ring shaft to secure the first awning ring within the elongated bore of the push rod gear;

h) a second awning ring securable to a pivot rod of the sink, the second awning ring having a second ring shaft configured to extend through the elongated bore of the pivot rod gear; and i) a second ring shaft e-ring securable around the second ring shaft to secure the second awning ring within the elongated bore of the pivot rod gear whereby, the push rod gear and the pivot rod gear transfer vertical motion of the push rod to the pivot rod to raise and lower a pop-up stopper at an upper opening of the drain pipe.

2. A pop-up drain stopper assembly, comprising:

a) a first gear having a lever arm at a first end connectable to a push rod of a sink and further having a plurality of teeth at an arcuate second end;

b) a second gear having a lever arm at a first end connectable to a pivot rod of a sink and further having a plurality of teeth at an arcuate second end, the plurality of teeth of the first gear engaged with the plurality of teeth of the second gear;

c) an enclosure having a first axle at a first end on which the first gear rotates and a second axle at a second end on which the second gear rotates; and d) an adjustable extension arm having a first end connected to the enclosure at the second end and further having a second connectable to a drain pipe of the sink;

e) whereby, the first and second gears transfer vertical motion of the push rod to the pivot rod to raise and lower a pop-up stopper at an upper opening of the drain pipe.

3. The pop-up drain stopper assembly of claim 2, wherein:
a) the enclosure has a first window formed in a sidewall at the first end through which the lever arm of the first gear extends; and
b) the enclosure has a second window formed in a sidewall at the second end through which the lever arm of the second gear extends.

4. The pop-up drain stopper assembly of claim 2, further comprising:
a) a first awning ring securable to the push rod and captured within an elongated bore in the lever arm of the first gear; and
b) a second awning ring securable to the pivot rod and captured within an elongated bore in the lever arm of the second gear.

5. The pop-up drain stopper assembly of claim 4, further comprising:
a) a first threaded bolt screwable into a threaded bore in the first awning ring against the push rod; and
b) a second threaded bolt screwable into a threaded bore in the second awning ring against the pivot rod.

6. The pop-up drain stopper assembly of claim 2, wherein the second gear is larger than the first gear.

7. The pop-up drain stopper assembly of claim 2, wherein the extension arm comprises:
a) a first section secured to the second end of the enclosure; and
b) a second section securable to the drain pipe, the second section slidable within the first section, whereby a distance between the enclosure and the drain pipe is adjustable.

8. The pop-up drain stopper assembly of claim 7, wherein:
a) the first section has a plurality of first spaced-apart openings formed in a first side; and
b) the second section has a plurality of second spaced-apart openings formed in a first side.

9. The pop-up drain stopper assembly of claim 8, further comprising:
a) a thumb screw insertable through a selected pair of the first and second spaced-apart openings in the first and second sections of the extension arm; and
b) a flange nut matable with the thumb screw.

10. The pop-up drain stopper assembly of claim 7, wherein:
a) the first section has a plurality of first spaced-apart threaded openings formed in a first side; and
b) the pop-up drain stopper assembly further comprises a threaded bolt screwable into a selected one of the threaded openings in the first section against the second section.

11. The pop-up drain stopper assembly of claim 2, further comprising:
a) a first clamp to which the second end of the extension arm is connected; and
b) a second clamp;
c) the first and second clamps configured to be secured to each other around the drain pipe, whereby the enclosure is securable a selected distance from the drain pipe.

12. A method of installing a pop-up drain stopper assembly to a sink drain, comprising:
a) providing a pop-up drain stopper assembly having first and second engaged gears within an enclosure and an extendable arm having a first end connected to a first end of the enclosure and a second end connected to a clamp, the first gear having an elongated bore in a first lever arm extending through a first window in a first side of the enclosure and the second gear having an elongated bore in a second lever arm extending through a second window in a second side of the enclosure opposite the first side;
b) securing the clamp around a drain pipe of the sink;
c) securing a first awning ring to a pivot rod of the sink;
d) inserting a first ring shaft of the first awning ring through the elongated bore in the first lever arm;
e) securing the first ring shaft with a first e-ring;
f) securing a second awning ring to a push rod of the sink;
g) adjusting the length of the extendable arm until the elongated bore in the second lever arm is adjacent the push rod;
h) inserting a second ring shaft of the second awning ring through the elongated bore in the second lever arm; and
i) securing the second ring shaft with a second e-ring;
j) whereby, the first and second gears transfer vertical motion of the push rod to the pivot rod to raise and lower a pop-up stopper at an upper opening of the drain pipe.

13. The method of claim 12, wherein the clamp comprises an anterior clamp to which the extension arm is connected and a posterior clamp and securing the clamp around the drain pipe comprises:
a) holding posterior clamp against the posterior side of the drain pipe;
b) holding the anterior clamp against the anterior side of the drain pipe;
c) inserting a first screw through bores through first ends of the anterior and posterior clamps;
d) securing the first screw with a first nut;
e) inserting a second screw through bores through second ends of the anterior and posterior clamps opposite the first ends; and
f) securing the second screw with a second nut.

14. The method of claim 12, wherein:
a) securing the first awning ring to the pivot rod comprises screwing a first thumbscrew into a threaded bore in the first awning ring until the first thumbscrew is tightened against the pivot rod; and
b) securing the second awning ring to the push rod comprises screwing a second thumbscrew into a threaded bore in the second awning ring until the second thumbscrew is tightened against the push rod.

15. The method of claim 12, wherein the extension arm comprises a first section and a second section that slides within the first section, the method further comprising:
a) inserting a screw through a selected one of a plurality of spaced-apart openings in the first section and through a corresponding opening in the section; and
b) securing the screw with a nut to lock the extension arm at the adjusted length.

16. The method of claim 12, wherein the extension arm comprises a first section and a second section that slides within the first section, the method further comprising:
a) inserting a screw through a selected one of a plurality of spaced-apart openings in the first section; and
b) tightening the screw against the second section to lock the extension arm at the adjusted length.

* * * * *